United States Patent [19]

Roberts

[11] Patent Number: 4,599,540

[45] Date of Patent: Jul. 8, 1986

[54] HIGH INTENSITY ARC LAMP

[75] Inventor: Roy D. Roberts, Newark, Calif.

[73] Assignee: ILC Technology, Inc., Sunnyvale, Calif.

[21] Appl. No.: 630,939

[22] Filed: Jul. 16, 1984

[51] Int. Cl.[4] ..... H01J 17/20; H01J 5/16

[52] U.S. Cl. ..... 313/570; 313/113; 313/643

[58] Field of Search ..... 313/634, 113, 643, 570, 313/44; 445/26, 22, 38, 58

[56] References Cited

U.S. PATENT DOCUMENTS

| | | | |
|---|---|---|---|
| 3,502,929 | 3/1970 | Richter | 313/113 |
| 3,715,613 | 2/1973 | Parkman | 313/113 |
| 3,731,133 | 5/1973 | McRae et al. | 313/113 |
| 3,808,496 | 4/1974 | McRae et al. | 313/44 |
| 3,852,629 | 12/1974 | Stuart | 313/595 |
| 3,862,449 | 1/1975 | Stuart et al. | 313/113 |

*Primary Examiner*—David C. Nelms
*Assistant Examiner*—William L. Oen
*Attorney, Agent, or Firm*—Thomas E. Schatzel

[57] ABSTRACT

An improved short-arc gas discharge lamp having a solid ceramic body with an integral reflector surface. The lamp includes a sapphire window, fitted to one end of the ceramic body, and a thermally and electrically conductive base fitted to the opposite end of the ceramic cylinder to form a sealed pressure chamber. The window is secured to a unitary U-shaped flange for improved strength and leak resistance. A pair of annular back-up rings secure the window flange to the ceramic body so as to relieve stress on the window flange. The reflective surface is formed by pressing the ceramic body, when hot, with an unpolished mandrel, for greater accuracy in surface configuration. A smooth, highly reflective surface is obtained by subsequent surface treatment.

8 Claims, 8 Drawing Figures

HIGH INTENSITY ARC LAMP

BACKGROUND OF THE INVENTION

1. Field of the Invention

The invention relates generally to arc lamps and more particularly to short arc lamps with improved structural and mechanical integrity, and improved light output.

2. Description of the Prior Art

In optical systems involving the generation and controlled radiation of long or continuous pulses of light, such as spectroscopy, or solar simulation, where high intensity, color correct illumination of sensitive working areas is required, such as in fiber optics illumination devices, it is advantageous to have a light source capable of producing the highest possible light flux density. Products utilized in such applications include short arc inert gas lamps, comprising a sealed chamber containing a gas pressurized to several atmospheres, and an opposed anode and cathode defining an arc gap. A window provides for the transmission of the generated light, and a reflector may be positioned surrounding the arc gap.

U.S. Pat. No. 3,502,929 issued to Richter discloses a high power, high output, short arc lamp utilizing a ceramic chamber sealed with a sapphire window. Richter discloses a cathode placed adjacent to the ceramic chamber and an anode suspended adjacent to the window. Because of heat generation at the anode during operation, the anode support structure, seals and window of Richter are relatively thin to dissipate the heat. At operational temperatures, the pressure inside the chamber may increase from approximately seventeen atmospheres to approximately thirty atmospheres. At this elevated pressure the lamp of Richter suffers from mechanical stress resulting in gas leakage and cracking of the window.

An attempt to solve these problems is disclosed in U.S. Pat. No. 3,731,133 issued to McRae et al., wherein the cathode and anode positions are reversed to provide the anode with a massive base for heat dissipation. While cracking due to heat was reduced, the problem of maintaining the integrity of the chamber under elevated pressure conditions remains. In particular, the window assembly of McRae et al. is secured to the ceramic cylinder by means of two J-shaped window flanges, placed one atop the other. These are in turn secured to a single thin back-up ring, brazed to the top of the ceramic cylinder.

It has been found that the single thin back-up ring may be insufficient to properly secure the window at operational pressures. Further the use of multiple components in the window assembly requires multiple seals, thus increasing the likelihood of leakage.

Other prior art attempts to alleviate the leakage, stress, and window cracking problems include that disclosed in U.S. Pat. No. 3,808,496 issued to McRae et al. This patent utilizes the teachings of McRae et al. '133 and places the anode in the lamp base and further provides a compression mounting for the window. U.S. Pat. No. 3,852,629 issued to Stuart discloses a window mounting using a single J-shaped flange.

Reducing the gas pressure in the lamps typically cures the leakage, stress, and cracking problems but photometric output is reduced and the voltage characteristics of the lamp change, reducing lumenous flux and brightness of the lamp. Different materials may also be employed in the lamp, for example, a quartz window, however these require a much more costly series of graded materials to effect a proper seal.

An additional problem with prior art lamps having a pressed ceramic cylinder with an integral reflective surface is that the reflector surface typically varies by a significant amount from the desired shape. Because the point of highest light intensity in the arc is very small, it is important that the focal point of the reflective surface coincide as closely as possible with this point to ensure the greatest light flux density. While much art, including McRae et al., are addressed to the problem of positioning the reflector relative to the cathode, there remains a need for improvements in the production of the reflector surface itself, whereby it may more closely conform to the desired curve, typically either parabolic or elliptical.

Integral reflector surfaces may be formed in the ceramic envelopes by pressing into a hot ceramic cylinder a mandrel having the desired shape. Because the reflector surface must be highly polished, the mandrel is polished to impart smoothness to the ceramic surface. Polishing a mandrel, however, is costly and inconsistent and tends to remove sufficient material from the mandrel to significantly alter the desired reflector shape. While mandrels may be polished to compensate for this, the methods to accomplish such compensated polishing are very costly and manufacturers tend to sacrifice accurate reflector shape for lower cost. The situation is further complicated by the tendency of ceramic to shrink as it cools during the firing process.

In view of the prior art, there remains a need for a short-arc lamp having improved leak and cracking resistance and with improved light output at nominal cost.

SUMMARY OF THE PRESENT INVENTION

It is therefore an object of the present invention to provide a lamp with improved mechanical and structural integrity at nominal cost.

It is a further object of the present invention to provide a lamp having increased explosion and crack resistance.

It is another object of the present invention to provide a lamp with improved leak resistance.

It is another object of the present invention to provide a lamp having an improved reflector for maximum light output for a given input power.

Briefly, a preferred embodiment of the present invention is an improved arc lamp comprising a pressurized, sealed envelope formed from a metal base, a ceramic cylinder and a sapphire window. The window is supported in a circular flange, having a U-shaped cross section, which is secured to the top of the ceramic cylinder via a pair of annular back-up rings. A cathode is suspended about a central longitudinal axis of the lamp by three radial support struts, secured to the back-up rings. An anode is centrally mounted about the base and extends upward therefrom to be positioned directly opposite the cathode, the anode and cathode together defining an arc gap. The inside surface of the ceramic body is formed to describe a parabola, and is coated with a reflective layer to form a reflective surface for imaging an arc. The parabolic surface is formed by pressing an unpolished mandrel into a pliable ceramic mass while the mass is still in a soft or "green" state prior to firing. The mandrel shape produces a surface curvature which, when the ceramic body is fired and cooled, will closely conform to a desired theoretical curvature. Strength and rigidity are imparted to the ceramic body by a high temperature firing and subsequent cooling. Because the unpolished mandrel results in a relatively rough surface, a smooth surface is obtained by coating the parabolic surface with a glaze. Finally a reflective film is deposited on the glaze to produce a highly reflective surface. A pair of metal bands at the top and bottom of the ceramic body aid in securing the base and window flange respectively, to the body, and also provide electrical contacts for the anode and cathode. Appropriate mounting and positioning holes are provided in the base as dictated by the lamp's specific application.

It is therefore an advantage of the present invention to provide a high intensity arc lamp with improved structural and mechanical integrity without increased cost.

It is a further advantage of the present invention that the lamp resists gas leakage, cracking and explosion from internal pressure.

It is a further advantage of the present invention that the lamp provides a greater light output at a given power level.

It is a further advantage of the present invention that tooling and manufacturing costs are reduced.

These and other objects and advantages of the present invention will no doubt become apparent to those of ordinary skill in the art after having read the following detailed description of the preferred embodiment which is illustrated in the various drawing figures.

IN THE DRAWING

DETAILED DESCRIPTION OF THE PREFERRED EMBODIMENT

Figure 1:
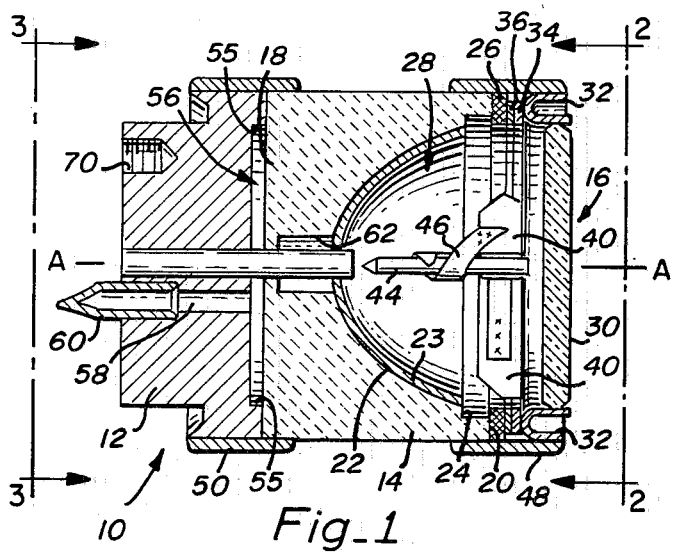
FIG. 1 is a side, partially sectional view of the lamp of the present invention.
Figure 2:
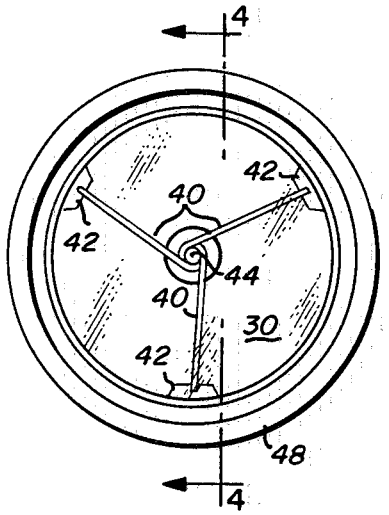
FIG. 2 is a top view of the lamp of FIG. 1 taken along line 2—2 of FIG. 1.
Figure 3:
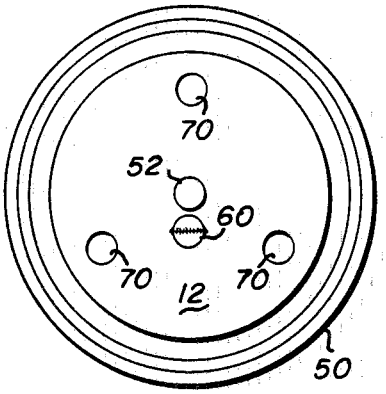
FIG. 3 is a bottom view, taken along line 3—3 of FIG. 1.

FIGS. 1, 2, and 3 illustrate a high intensity, short arc lamp of the present invention and designated by the general reference character 10. The lamp 10 has a central axis A and includes a base 12, a ceramic cylinder 14 and a window assembly 16, also illustrated in detail in FIG. 4.

The ceramic cylinder 14 is preferably of a ceramic such as alumina AD 94.5 manufactured by Coors Porcelain Corporation of Golden Colorado. The cylinder 14 is metallized to simplify attachment of metallic components thereto, for example by brazing. The metallization for the cylinder 14 utilizes a mixture of molybdenum and manganese which is painted onto the ceramic cylinder 14 and secured by firing.

The cylinder 14 includes a flat bottom surface 18 defining a circle, a flat upper surface 20 defining a ring and a curved reflective surface 22, which may be parabolic, elliptical or aspherical. In the lamp 10 the surface 22 is parabolic. Coated onto the reflective surface 22 are a plurality of layers, collectively referred to as coating 23, which cooperate to provide the desired shape and reflectivity for the surface 22. It can be seen in FIG. 1 that the cylinder 14 has a lip 24 around the upper surface 20 thereof. A metallized ceramic spacer 26, defining a ring, is secured to the lip 24 by a copper braze. The spacer 26 has an outside diameter equal to the outside diameter of the cylinder 14, and an inside diameter extending slightly past the lip 24.

Figure 4:
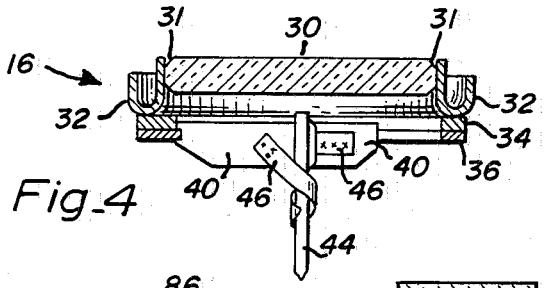
FIG. 4 is a side, partially sectional view, taken along line 4—4 of FIG. 2, showing details of the window assembly.

The window assembly 16, illustrated in FIG. 4, fits atop the spacer 26 of the cylinder 14 to create a sealed cavity 28. The window assembly 16 includes a disk-shaped window 30 of, for example sapphire. The window 30 includes chamfered edges 31 to provide additional surface area for sealing the window 30 to a window flange 32. The window flange 32 is circular, with a U-shaped cross section and has an inside diameter just slightly greater than an outside diameter of the window 30 so that the window 30 snugly fits therein. It may be noted that the lower edge of the window 30 is not flush with the lower edge of the window flange 32, but is elevated slightly. This provides a gas space to aid in heat dissipation. The window 30 is approximately one-eighth of an inch thick and secured to the flange 32 by a silver braze, applied about the chamfered edges 31. The outside diameter of the flange 32 is equal to the outside diameter of the cylinder 14, and is aligned therewith. The flange 32 is formed of an alloy of iron, nickel and cobalt having a coefficient of thermal expansion approximating that of ceramic, and in the lamp 10 is formed of such an alloy sold under the trademark Kovar. A first back-up ring 34 is brazed to the bottom of the U-shaped window flange 32 and a second backup ring 36 is brazed to the bottom of the first backup ring 34. Each back-up ring 34 and 36 is formed of the same material as the window flange 32, for example Kovar. The rings 34 and 36 are congruent in dimensions, and each is approximately thirty thousandths of an inch thick. Each ring 34 and 36 has an outer diameter equal to the outer diameters of the cylinder 14, spacer 26 and window flange 32, and the rings 34 and 36 have inside diameters approximately equal to the inside diameter of the window flange 32. The window flange 32 is secured to the upper back-up ring 34 using a copper-silver (cusil) braze.

The window assembly 16 further includes three support struts 40, illustrated in FIG. 2, secured to the back-up rings 34 and 36 and radially positioned approximately one hundred and twenty degrees apart. The struts 40 are formed of molybdenum and are generally rectangular with one corner truncated. The struts 40 are secured by a copper braze to notches formed in protrusions 42 of the backup rings 34 and 36. The three struts 40 support a rod-shaped metallic cathode 44 of, for example tungsten. A band of metal known as a getter 46 may be secured to the window assembly 16, and in the lamp 10, two getters 46 are attached to the struts 40 and the cathode 44. The getters 46 are typically fabricated of zirconium and function to absorb impurities formed within the cavity 28 during operation of the lamp 10.

The window assembly 16 fits onto the spacer 26 of the ceramic cylinder 14 and the lower backup ring 36 is brazed to the spacer 26. A band metal 48, of the same type utilized in the backup rings 34 and 36 and flange 32, for example Kovar, is brazed to the outside of the cylinder 14 and to the outside edges of the back-up rings 34 and 36. The band 48 is approximately thirty thousandths of an inch thick, and extends upwardly to the level of the outside edge of the U-shaped flange 32. A tungsten inert gas (TIG) weld is formed where the flange 32 meets the band 48. The Kovar band 48 aids in securing the window assembly 16 and also serves as an electrical contact for the cathode 44 by conducting current to the cathode 44 through the back-up rings 34 and 36 and the support struts 40.

The flange 32, rings 34 and 36 and band 48 cooperate to form a secure seal which resists stress, leakage and cracking caused by the high internal operating pressures. The unitary construction of the U-shaped flange eliminates the necessity for an additional seal, thus reducing the likelihood of leakage. The U-shape of the flange 32 provides a large contact area between both the window 30 and the flange 32, and the flange 32 and the band 48. The U-shape further allows for expansion of the window 30 in a radial direction. The rings 34 and 36 secure the flange 32 to the cylinder 14 very tightly to resist bending and loss of structural integrity. It may be noted that while the rings 34 and 36 are separate components in the disk 10, they are brazed together by a copper braze, and functionally may be considered a unitary piece. The rings 34 and 36 may, in fact be replaced by a single ring of dimensions equivalent to the two rings 34 and 36, and in the disk 10 the use of two congruent rings provides a manufacturing advantage.

The window assembly 16 advantageously is directly inserted onto the cylinder 14 as a subassembly, thus maintaining critical tolerances, for example, the position of the cathode 44 relative to a focal point of the reflective surface 22.

The base 12 is secured to the surface 18 of the cylinder 14 by a band of metal 50, also preferably of Kovar. The band 50 is substantially congruent to the band 48 and is brazed to the cylinder 14 where the band 50 and cylinder 14 abut. At the lower end of the band 50, the band 50 and base 12 are welded, e.g. TIG welded. A metallic, rod-shaped anode 52, of, for example tungsten, penetrates through the base 12 about the central axis A and extends to a point less than two centimeters, and typically less than one centimeter from the cathode 44. The base is formed of substantially pure iron and in the lamp 10 is of an iron sold under the trademark Mirror Mold. The base material is chosen for its electrical and thermal conductivity characteristics. The base 12 functions both as a heat sink for the anode 52 and to conduct electrical current from the anode 52 to the band 50 which functions also as an electrical contact.

A pair of shoulders 55 formed on the base 12 space the base 12 slightly away from the cylinder 14 such that a circular aperture 56 is formed. A tube 58 extends perpendicularly through the base 12 and communicates with the aperture 56, and with the outside environment. A pinch-off 60 is inserted into the tube 58 and can be sealed once the cavity 28 is filled with the appropriate gas. The cavity 28 communicates with the aperture 56 via an aperture 62 formed about the disk central axis 11 and surrounding the anode 52.

The cavity 28 is filled with an inert gas, for example xenon, krypton or argon through the tube 58, and pressurized. When the desired pressure is reached, the pinch-off 60 is sealed, confining the pressurized gas in the cavity 28. In the lamp 10, the gas utilized is xenon and is pressurized to approximately seventeen atmospheres.

The base 12 further includes a plurality of threaded mounting holes 70, illustrated in FIGS. 1 and 3, which aid in both mounting and aligning the lamp 10.

Figure 7:
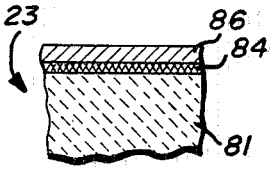
FIG. 7 is a schematic side-sectional view of the coating of the reflective surface of the ceramic cylinder, taken along line 7—7 of FIG. 5.
Figure 5:
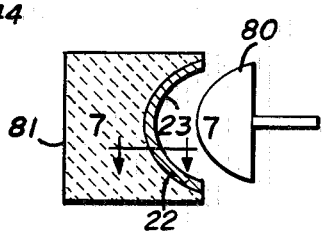
FIG. 5 is a schematic view of a ceramic cylinder and mandrel used to form a reflective surface therein.
Figure 6A:
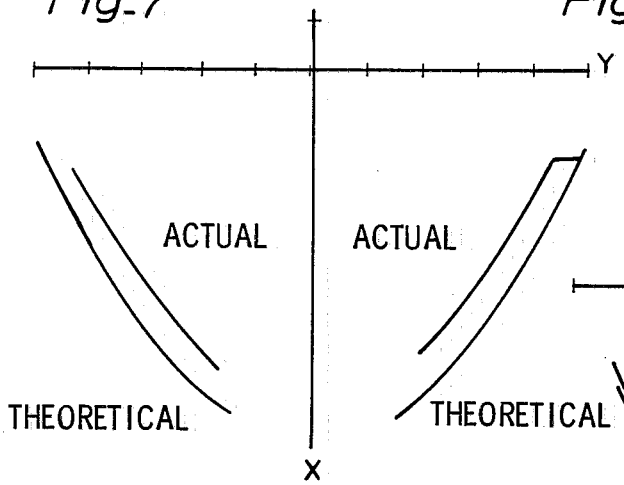
Fig 6A (PRIOR ART)
FIG. 6A is an x-y plot of a parabola, showing the difference between the theoretical and actual curves of the reflective surface when the prior art method of polishing the pressing mandrel is used.
Figure 6B:
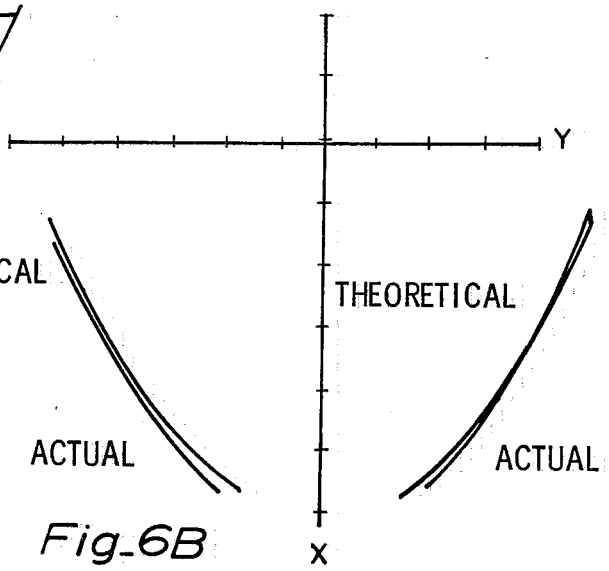
FIG. 6B is an x-y plot of a parabola, showing the actual and theoretical shape of the reflective surface of the present invention.

To form the cavity 28 in the cylinder 14, a mandrel 80, illustrated in FIG. 5, is pressed into a ceramic mass 81 while the mass 81 is still in a "green" state. Strength and hardness are imparted to the mass 81 by a high temperature firing. It has been found that by not polishing the mandrel 80, the surface 22 much more closely conforms to a theoretical curve when the cylinder 14 is cooled after firing. The mandrel 80 additionally is shaped to compensate for a shrinkage which the mass 81 undergoes as it is cooled. The cooled mass 81, with the concave surface 22 comprises the cylinder 14. FIG. 6A illustrates theoretical and actual curves for a polished mandrel, and FIG. 6B illustrates such curves for the unpolished mandrel 80. By not polishing the mandrel 80, the curve of the surface 22 is more accurate but its roughness is correspondingly increased. This is corrected by coating the surface 22 with the coating 23 as shown in FIG. 1 and in detail in FIG. 7. The coating 23 comprises a silica glaze 84 which is sprayed into the surface 22 and fired separately on the cylinder 14. The glaze 84 is sprayed as a high viscosity layer and provides the final smooth surface for a reflective film 86, which may be any suitable reflective material such as silver, gold or aluminum. In the disk 10, the reflective film 86 comprises an evaporated silver film.

It may be noted that the ceramic cylinder 14 tends to shrink during cooling and may do so unevenly, thus potentially affecting the curve of the surface 22. Additionally, the glaze 84 tends to sag, in a consistent manner, due to gravity. Both of these conditions can be compensated for during fabrication of the mandrel 80, so that the final shape of the reflective layer 86 is extremely close to the calculated value.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. An arc lamp comprising:

a cylindrical base formed of an electrically and thermally conductive material;

a ceramic body comprising a cylinder into which a concave reflector surface has been formed about a central axis of rotation of the body, said concave reflective surface having a discrete focal point about said central axis and opening about a first end of the body, the body including a second end for abutting with the cylindrical base;

a disk-shaped sapphire window mounted in a unitary circular flange having a U-shaped cross section, said flange being formed of an alloy of iron, nickel and cobalt having a coefficient of thermal expansion similar to that of ceramic, the window including chamfered edges whereby a junction of said edges and said flange may be brazed, the window being held in compression by said flange, the window and flange being sealingly mounted to the body about said first end whereby a sealed cavity is defined by said concave reflective surface and the window and flange;

at least one annular metallic back-up ring positioned intermediate to and secured to said window support flange and to the ceramic body, the back-up ring being formed of an alloy of iron, nickel and cobalt having a coefficient of thermal expansion similar to that of ceramic whereby said U-shaped flange remains securely affixed to said ceramic body during thermal expansion thereof; and an anode and a cathode disposed about said central axis of rotation of the lamp, the anode being positioned within and secured to the base and including a tip extending into said concave reflective surface to coincide with said focal point, said cathode being disposed adjacent to said window and having a tip positioned less than two centimeters from said anode tip.

2. The lamp of claim 1 wherein, said base material is substantially pure iron, the ceramic body is an alumina, and said concave surface is a parabolic surface.

3. The lamp of claim 1 and further including a silicon glaze, coated onto said concave surface and subsequently fired on, and an evaporated silver film, coated onto said glaze whereby a smooth reflective surface is formed.

4. The lamp of claim 1 wherein said gas is selected from the group consisting of xenon, argon and krypton; and said gas is pressurized to approximately seventeen atmospheres.

5. The lamp of claim 1 wherein, the base is secured to the ceramic body by a lower metallic band encircling and abutting both the base and a lower portion of the ceramic body; and said window flange is further secured to the ceramic body by an upper metallic band, encircling and abutting both said window flange and an upper portion of the ceramic body, said upper and lower bands being brazed to their abutting components.

6. In an arc lamp of the type including a sealed envelope comprising a cylindrical ceramic body having an integral concave reflective surface, sealed at a first end by a metallic base and sealed at a second end by a disk-shaped sapphire window, said envelope housing an anode mounted in the base and including a tip extending past said concave surface to coincide with a focal point thereof, and a cathode adjacent to the window and spaced less than two centimeters from the anode, said envelope being filled with an inert gas under at least one atmosphere of pressure, the improvement comprising:

a unitary circular window mounting flange having a U-shaped cross-section, the inner diameter thereof being adapted to receive a sapphire window whereby said window may be held in compression thereby, said window including upper and lower chamfered edges being secured to the flange by brazing, the flange having an outside diameter equal to an outside diameter of said ceramic body for abutting a metallic band encircling both said cylinder and the flange whereby the flange may be secured thereto by brazing; and at least one annular metallic back-up ring having a thickness of at least sixty thousandths of an inch, positioned intermediate to and brazed to an upper surface of the body and to a lower portion of the U-shaped flanged whereby the flange is securely fastened to said body.

7. The improved arc lamp of claim 6 wherein, the flange and the back-up ring are fabricated of a metal alloy of iron, nickel and cobalt having a coefficient of thermal expansion approximately equal to that of the ceramic cylinder.

8. The improved arc lamp of claim 6 wherein, said back-up ring comprises two annular back-up rings of substantially congruent dimensions, each being at least thirty thousandths of an inch thick and brazed together to function as a unitary piece.

* * * * *